United States Patent [19]

Cromartie

[11] Patent Number: 4,989,273

[45] Date of Patent: Feb. 5, 1991

[54] SWIMWEAR STAY FOR WATER SKIERS

[76] Inventor: Hendrick L. Cromartie, 2 Ridgewood Rd., Rome, Ga. 30161

[21] Appl. No.: 424,928

[22] Filed: Oct. 23, 1989

[51] Int. Cl.[5] ..... A41D 7/00; A41D 27/20

[52] U.S. Cl. ..... 2/231; 2/250; 2/227; 2/67; 2/23

[58] Field of Search ..... 2/67, 238, 231, 228, 2/227, 248, 247, 233, 23, 22, 250, 256, 255; 450/114, 146, 143

[56] References Cited

U.S. PATENT DOCUMENTS

| | | | |
|---|---|---|---|
| 1,767,372 | 6/1930 | King | 2/22 |
| 3,148,681 | 9/1964 | Herbener | 450/146 |
| 3,637,230 | 1/1972 | Poik | 2/23 |
| 4,455,686 | 6/1984 | Zide | 2/23 |

FOREIGN PATENT DOCUMENTS

| | | | |
|---|---|---|---|
| 971703 | 7/1975 | Canada | 2/23 |
| 3638718 | 8/1987 | Fed. Rep. of Germany | 2/23 |

*Primary Examiner*—William A. Cuchlinski, Jr.

*Assistant Examiner*—William C. Dowling

*Attorney, Agent, or Firm*—Vivian L. Steadman

[57] ABSTRACT

A loose-fitting boxer-type bathing suit having a pair of elongated, trapezoidally-shaped stays insertable into pockets stitched to the inside of the legs of the suit. Each pocket includes a short seam which juts inwardly, partially blocking the entrance to the pocket. The distance between this short seam and a bottom of the pocket is approximately equal to the overall length of the stay, so that a snug fit between it and the pocket is attained. Away from the short seams, the upper edges of both stays slope downwardly towards the wearer's crouch. The stays are positioned a sufficient distance below the waistband of the bathing suit that both upper edges lie generally parallel to and slightly below the two natural creases that form between the wearer's torso and his thighs when his body is bent forward at the hips. These natural creases tend to prevent the legs of the bathing suit, reinforced by the stays, from riding up. In the event the legs do ride up anyway, the stays make them pop back down.

7 Claims, 1 Drawing Sheet

41
42
33
43
14
10
35
32
30

33
27
13
14
25
32
22
26
35
15
16
17
37

13
A
14
10
15
16
17

SWIMWEAR STAY FOR WATER SKIERS

BACKGROUND OF THE INVENTION

The present invention relates to inserts for swimwear and in particular to inserts for boxer-type bathing suits.

For a variety of reasons, most water skiers prefer to wear loose-fitting, boxer-type bathing suits instead of short, form-fitting suits. Even so, these water skiers have in the past experienced a discomforting phenomenon.

At the beginning of a ski run as a skier comes out of the water, water pressure resisting his forward momentum tends to cause the legs of a loose-fitting, boxer-type suit to ride up. Usually, the bottom edges of the suit are forced up to points near the junctures of the wearer's torso and thighs. In as much as the suit is wet, its legs tend to remain bunched up proximate the natural creases between the wearer's torso and his thighs even after he has assumed a normal skiing position.

When this situation arises, most skiers feel themselves compelled, either due to discomfort or for other reasons, to pull down the front of each leg of the suit. This activity, however, necessitates the skier's releasing his grasp, alternately with one hand and then with the other, on the bar of the rope by which he is being towed. Such maneuvers are troublesome even for expert skiers. For beginners and less than expert skiers, adjusting the legs of one's bathing suit can mean losing one's balance. Despite the risk of falling, skiers at all levels of ability still seem compelled to make these adjustments.

Even for a non-skier, the legs of a loose-fitting, boxer-type bathing suit may ride up during such routine acts as sitting.

SUMMARY OF THE INVENTION

It is among the objects of this invention to provide a loose-fitting bathing suit with legs that resist riding up on a wearer and yet is comfortable and unobtrusive to wear.

In accordance with the invention, there is provided a pair of stays insertable into pockets stitched to the inside of the legs of a bathing suit, the pockets having means for retaining the stays in position within the pockets and proximate a wearer's thighs but away from his torso, even when the thighs are flexed at the hip joints, so that the legs of the suit pop back down whenever they are displaced upwardly.

DESCRIPTION OF THE PREFERRED EMBODIMENT

Figures 1, 2, 3:
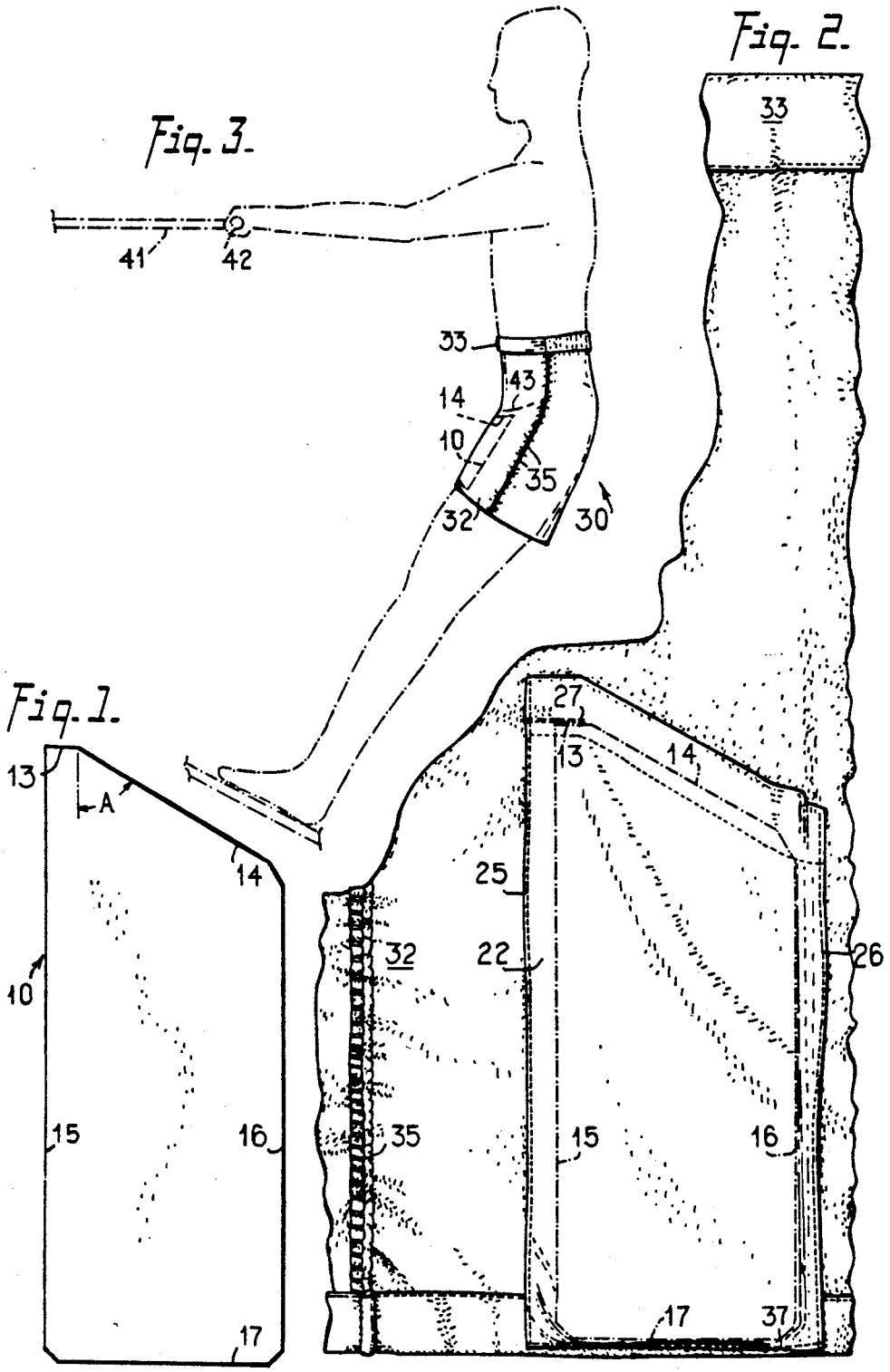
FIG. 1 is an elevational view of a stay according to the present invention.
FIG. 2 is an elevational view of the stay according to FIG. 1 held within a pocket stitched to a typical boxer-type bathing suit, only a fragmentary section of the suit being shown.
FIG. 3 shows a side view of a bathing suit in which each leg of the suit is reinforced by a stay situated on the inside of the leg, the stay situated on the inside of the left leg being held within a pocket according to FIG. 2, when the bathing suit is worn by a water skier.

Referring to the drawings, an elongated stay 10 is held within a pocket 22. The stay 10, which is generally trapezoidal in shape, is preferably fabricated from a thin sheet of polypropylene felt which measures, by way of example, approximately 0.075 inch in thickness. This felt exhibits the desirable properties of drying out approximately as fast as the materials in a typical boxer-type bathing suit 30 and of floating even when soaked in water. Importantly, a three inch wide stay 10 formed from this felt and secured within the pocket 22 has sufficient rigidity to prevent the leg 32 of the suit 30 from riding up.

The pocket 22, which, like the stay 10, is generally trapezoidal in outline, is stitched to the inner surface of the left leg 32. A second pocket (not shown), which in outline and position relative to the remainder of the suit 30, is generally a mirror image of the pocket 22, is stitched to the inner surface of the right leg and is provided to hold the stay 10 so that the opposite side thereof from the side shown in FIGS. 1 and 2 is directed toward a wearer's body. Both pockets are preferably fabricated of a light gauge nylon or the like. Within the pocket 22, paired lateral and medial seams 25, 26 are disposed parallel to each other and spaced approximately ½ inch further apart than the width of the stay 10 held between them. The lateral seam 25 is disposed approximately parallel to, and spaced about 2 inches from, a side seam 35 formed in the suit 30. Thus situated toward the outer side of a wearer's leg, the stay 10 tends to rotate towards the middle of the leg, the optimum position for the stay to prevent the suit from riding up, as a wearer bends his legs at the hips (FIG. 3).

As illustrated in FIG. 2, a short seam 27, approximately ½ inch long, juts inwardly and perpendicularly from the lateral seam 25. The seam 27 is situated about ½ inch below the top of the pocket 22, keeping the edges 13, 14 of the stay 10 out of contact with the wearer's skin. Moreover, the distance between the short seam 27 and a bottom seam 37, which is disposed along the lower edge of the leg 32, is approximately equal to the overall length of the stay 10. This relationship provides for a snug fit between the stay 10 and the pocket 22. The fit is such that a truncated corner 13, provided on the upper edge 14 of the stay 10, abuts the proximate short seam 27 (FIG. 2).

Furthermore, for suits 30 worn by adults, the truncated corner 13 of each stay 10 is preferably disposed about 7½ inches below the top of the waistband 33 of the suit 30. From the corner 13, the upper edge 14 of each stay 10 slopes downwardly away from the proximate lateral seam 25 and towards the wearer's crouch. The angle A at which the upper edge 14 is oriented with respect to an imaginary line drawn parallel to the side edge 15 is preferably about 60 degrees (FIG. 1). When a stay 10 is held in a pocket 22, the edge 14 lies generally parallel to and slightly below one of the natural creases 43 that form between the wearer's torso and his thighs when his body is bent forward at the hips (FIG. 3).

The natural creases formed by the flexion of the wearer's thighs at their junctures with the body, as well as the barrier formed by the short seam 27, tend to prevent the stay 10 from being ejected accidentally from the pocket 22. Nevertheless, even with the longitudinal position of the stay 10 relative to the pocket 22 determined by the seams 27, 37, the leg 32 may still ride up on a water skier as he is being pulled out of the water at the beginning of a run. Once he leaves the water, however, the stay 10 causes the leg 32 to pop back down, eliminating the need for the skier to adjust them downwardly.

With the short seam 27 extending inwardly no further than a distance corresponding to the total separation between the sides of the pocket 22 and the stay 10, enough leeway is provided so that a stay can be removed from the pocket and replaced as desired.

What is claimed is:

1. In a boxer-type bathing suit with a pair of legs, the improvement comprising:

(a) at least one elongated stay; and (b) at least one pocket which is joined to one of the legs of the suit along the bottom of the pocket and which has a short seam which juts inwardly, partially blocking the entrance to the pocket; the stay being insertable into the pocket; the distance between the short seam and the bottom of the pocket being approximately equal to the overall length of the stay, so that when the stay is disposed entirely within the pocket, a portion of the stay abuts the short seam; the stay being positioned a sufficient distance below the top of the suit so that said portion is adapted to lie below a natural crease that forms between a wearer's torso and his thigh proximate the stay when his body is bent forward at the hips.

2. In a boxer-type bathing suit with a pair of legs, the improvement comprising:

(a) at least one elongated, trapezoidally-shaped stay; and (b) at least one pocket which is joined to one of the legs of the suit along the sides and bottom of the pocket and which has a short seam which juts inwardly, partially blocking the entrance to the pocket; the stay being insertable into the pocket; the distance between the short seam and the bottom of the pocket being approximately equal to the overall length of the stay, so that when the stay is disposed entirely within the pocket, a portion of the stay abuts the short seam; an upper edge of the stay sloping downwardly away from said portion; the stay being positioned a sufficient distance below the top of the suit so that the upper edge is adapted to lie generally parallel to and slightly below a natural crease that forms between a wearer's torso and his thigh proximate the stay when his body is bent forward at the hips.

3. The improvement according to claim 2 wherein the stay further comprises a pair of elongated edges disposed approximately parallel to each other and wherein the upper edge of the stay is further characterized as being disposed at an angle of about 60 degrees with respect to an imaginary line drawn parallel to the elongated edges.

4. In a loose-fitting, boxer-type bathing suit with a pair of legs adapted to be worn proximate a wearer's thighs, the improvement comprising:

(a) at least one elongated stay;

(b) at least one pocket which is joined to one of the legs, the stay being insertable into the pocket; and (c) means for retaining each end of the stay, when it is inserted into the pocket, in such a manner that both ends of the stay continue to abut fixed points within the pocket even when the thighs are flexed, the stay being positioned downwardly of the top front of the suit a sufficient distance so that the stay is adapted to lie proximate the front of one of the wearer's thighs, so that the leg of the suit to which the pocket is joined tends to pop back down whenever the leg is displaced upwardly.

5. The improvement according to claim 4 wherein the retaining means includes means for partially blocking the entrance to the pocket, the blocking means and the bottom of the pocket being spaced apart a distance which is approximately equal to the overall length of the stay, thereby providing a snug fit for the stay.

6. The improvement according to claim 5 wherein the means for partially blocking the entrance to the pocket further comprises a short seam which juts inwardly from one of the sides of the pocket.

7. The improvement according to claim 4 wherein the stay is further characterized as being positioned below a natural crease that forms between a wearer's torso and his thigh proximate the stay when his body is bent forward at the hips.

* * * * *